United States Patent [19]

Svantesson

[11] Patent Number: 4,911,071

[45] Date of Patent: Mar. 27, 1990

[54] METHOD OF MULTICOLOR SILKSCREEN PRINTING

[76] Inventor: 521 Ake Svantesson, Apertado 36, Fuengirola, Malaga, Spain

[21] Appl. No.: 177,444

[22] Filed: Apr. 4, 1988

[30] Foreign Application Priority Data

Apr. 2, 1987 [SE] Sweden ..... 8701393

[51] Int. Cl.[4] ..... B41F 15/10

[52] U.S. Cl. ..... 101/129; 101/115

[58] Field of Search ..... 101/115, 129, 126

[56] References Cited

U.S. PATENT DOCUMENTS

| | | | |
|---|---|---|---|
| 3,040,657 | 6/1962 | Ichinose | 101/115 |
| 3,329,796 | 7/1967 | Manwaring | 219/10.55 |
| 4,214,522 | 7/1980 | Bille | 101/128.4 |
| 4,221,165 | 9/1980 | Ericsson | 101/126 |
| 4,516,495 | 5/1985 | Ericsson | 101/129 |
| 4,589,335 | 5/1986 | Svantesson | 101/114 |
| 4,610,200 | 9/1986 | Metso | 101/126 |

FOREIGN PATENT DOCUMENTS 2045728A 11/1980 United Kingdom .

*Primary Examiner*—Clifford D. Crowder

*Attorney, Agent, or Firm*—Burns, Doane, Swecker & Mathis

[57] ABSTRACT

The present invention relates to a method for applying a plurality of color prints onto print material. The method utilizes a silkscreen printer arrangement which includes a plurality of printing tables positioned in a travel path of the print material. A print material transporting arrangement is provided so as to move the print material through the plurality of printing tables. Various colors are applied to the print material in a predetermined order. Activation of gripping devices for gripping the print material and vertical movements of the printing tables are coordinated dependent upon positioning of the print materials with respect to the printing step being performed. Similarly, the gripping devices are released and the printing tables likewise move to a non-printing position subsequent to the movement of the print material from the print table associated with the given silkscreen printing machine.

1 Claim, 1 Drawing Sheet

METHOD OF MULTICOLOR SILKSCREEN PRINTING

TECHNICAL FIELD

The present invention relates to a method and silkscreen printer arrangement comprising a multiple of printing tables or like support surfaces, for printing on a single piece of print material in a given order a plurality of colour patterns which form in combination on said material a complete multicoloured printed pattern.

Silkscreen printer arrangements with which a plurality of coloured patterns can be printed on one and the same print material in a given order normally comprise a plurality of individual printers which are coupled together sequentially and each of which is intended to apply a single colour pattern to the print material.

Thus, a first colour pattern is applied to the print material in a first silkscreen printer, a second colour pattern which is different from the colour of the first pattern printed on the material is then printed onto said material in a second silkscreen printer, whereafter the procedure is repeated in subsequent printers until the ultimate multicoloured print is obtained.

Normally, it suffices to use four such silkscreen printers connected in series, each of the printers being intended to print a respective colour pattern onto the print material.

The method and silkscreen printer arrangement according to the present invention are based on the principles utilized in known silkscreen printers of the kind which include a horizontal, vertically movable printing table, which is positioned beneath a stencil on which there is provided a first, single-colour pattern, and of the kind which include print material conveying means having two gripping means, of which a first gripping means is intended for feeding print material onto the printing table with the table located in a lowered position, whereafter the table is raised to an upper, printing position in which the first colour print is applied to he print material, subsequent to which the first gripper means is released from said material.

While the first gripping means feeds print material onto the printing table, the second gripping means feeds preceding print material onto a disposal table.

The printing table is then lowered to its lower position, whereafter the gripping means are returned to their respective positions, in which the first gripping means grips fresh print material to be printed and, with the printing table in its raised position, the second gripping means grips the newly printed material and upon subsequent displacement of the two gripping devices, after the table has been lowered to its lower position, a print can be applied to said fresh print material and the printed material moved to the disposal table.

BACKGROUND PRIOR ART

A silkscreen printer which is intended for applying to print material a first printed pattern consisting of a first colour is illustrated in FIGS. 3 and 4 of the U.S. Pat. Specification No. 4 589 335, which is considered equivalent to the content of the Canadian Patent Specification No. 1 197 138.

In the case of this known silkscreen printer, the printing table is carried by a parallel linkage system by means of which the horizontal printing table is moved to a lower position for movement of the gripping means, and to an upper position in which printing of a pattern onto the print material takes place.

During the time in which the gripping means displaces the print material from the material laying-on position to the printing position on the printing table, the printing table is located in its lower position and the gripping means pass over the printing table along stationary guide means.

However, when the gripping means are located above the printing table in a position for the application of print onto the print material, the printing table is raised to its upper position so that said print can be applied.

The print material is then fed to the printing table by said gripping means and the printing table is lowered, whereafter the gripping means return to the earlier mentioned position and there collect further print material, at the same time as the second gripping means grip the newly printed material, subsequent to raising the printing table.

It is also known in prior art silkscreen printer arrangements to arrange in the transport path of the print material a print material laying-on table, a silkscreen printer, a drying section, a depositing table, a further laying-on table, a further silkscreen printer, a further drying section and a further depositing table, etc, thereby to construct a single printing plant or "line" in which a multicolour print can be applied to a single piece of print material. It will be obvious that such a silkscreen printing line will occupy a large amount of space.

Thus, a silkscreen printer arrangement comprising a plurality of silkscreen printers and intended for applying a multicolour print onto one and the same piece of print material is known from the aforementioned U.S. Pat. Specification No. 4 589 335.

The reason why a drying arrangement, which is normally highly space consuming, is required after each silkscreen printer is because the print applied to the print material in one silkscreen printer must be completely dry before further print is applied to the print material in the following silkscreen printer.

It is generally known that printing "wet-in-wet" results in poor print quality when printing in silkscreen printers, since during a subsequent printing sequence the undersurface of respective stencils is brought into contact with the wet print previously applied.

Various types of drying apparatus are also known to the art. One such drying apparatus which can be used advantageously in silkscreen printers, although subsequent to making certain modifications, primarily to the printer, is one by means of which water-based inks or pastes can be dried by means of electromagnetic waves at radio frequency. An example of one such drying apparatus is found illustrated and described in the U.S. Pat. Specification No. 3 329 796.

It can also be mentioned that the U.S. Pat. Specification No. 4 516 495 teaches, inter alia, a method of sensing the prevailing position of print material or print on the printing table, thereby enabling any deviations from a set-point value to be established, so that the position of the stencil frame can be adjusted towards this setpoint value prior to transferring the stencil print onto the print material.

SUMMARY OF THE PRESENT INVENTION

1. Technical Problems

When considering the present state of the prior art as described above, and when considering that strenuous efforts have been made over a long period of time to provide a silkscreen printer arrangement in which a plurality of colour patterns can be applied in a given order to a single piece of print material in order to obtain a multicoloured print, it will be seen that a technical problem resides in the realization that one silkscreen printer of known construction among a plurality of silkscreen printers operating in accordance with mutually different principles, can be utilized advantageously to produce such multicoloured prints.

It will also be seen that a further technical problem resides in complementing, with simple means, a gripper system which comprises two gripping devices so that more than two gripping devices can be used and so that said gripping devices can be located at a given distance apart, while still providing conditions which will enable print material which is to receive a multicoloured print to be brought to a precise registered position on each printing table.

Another technical problem is one of creating conditions, with the aid of simple means, which will enable the laying-on or feeding position for plain material to receive print to be located in the same plane as the supporting surfaces of each of the printing tables in the upper, printing positions of said tables.

It will also be seen that a further technical problem resides in coupling the transporting means, by means of which the print material is carried through one printer, to a further one, two or more similar transporting means and silkscreen printers.

Another technical problem resides in the ability of connecting together two or more silkscreen printers, with the aid of relatively simple means, such as to leave between mutually adjacent printers a small space which will accommodate a drying apparatus or drying section by means of which print can be dried rapidly.

A more qualified technical problem in this regard resides in the ability of coupling one material transporting means of a first silkscreen printer with a corresponding transporting means of an adjacent similar silkscreen printer while still affording an intermediate space for a drying apparatus.

When desiring to install drying apparatus in the space between two closely adjacent silkscreen printers, a technical problem resides in selecting, from among all available drying apparatus, a drying apparatus which has an energy consumption essentially adapted to prevailing and momentary loads, i.e. momentary drying requirements.

A further technical problem resides in the selection of drying apparatus which is constructed so as not to require a heating-up period, and which, when the need arises, will immediately and automatically dry the wet print throughout the whole of its thickness.

A further technical problem resides in the selection of a drying apparatus which is so effective as to be capable of drying the wet print during the relatively short length of material travel available without heating the print material to any appreciable extent and at low energy consumption.

Another technical problem resides in the selection of an effective, low-power drying apparatus suitable for the aforesaid purpose and for the aforesaid application, which will dry water-based inks or pastes uniformly irrespective of where the water-based print is placed on the print material.

A further technical problem resides in the selection of drying apparatus which is particularly suited for drying water-based inks or pastes, thereby to reduce or eliminate environmentally harmful products generated during the drying process.

It must also be considered a technical problem to provide, with the aid of simple means, conditions such that the printer components which, of necessity, are displaced linearly over or extend across the space between two mutually adjacent silkscreen printers can be constructed so as not to impair in any way the drying effect of the drying apparatus while still ensuring a good fit and precise registration of the print material on respective printing tables throughout the whole of the silkscreen printer arrangement used.

2. Solution

The present invention relates to a silkscreen printer arrangement in which a plurality of colour prints can be applied in a given order onto a single piece of print material in a manner to create thereon a multicoloured print.

The invention is based on the principle of "extending" a known silkscreen printer by incorporating in said printer arrangement a multiple of printing tables which are positioned in the path travelled by the print material through the printer arrangement and each of which printing tables cooperates with a respective stencil which is intended to transfer to the print material a respective single colour of said multicolour print, and which printer arrangement further includes a print material transporting means which is intended to advance print material first to a first printing table, where said first colour print is applied to said print material by the stencil located above said first table, and then to a second printing table, where a second colour print forming part of said ultimate multicolour print is applied to the print material by the stencil located above said second table, and so on.

The method according to the present invention is characterized by unique co-action between the transporting means, the activation of the print material gripping devices, and the vertical movement of the horizontal printing table.

The following procedural steps are carried out when practicing the inventive method;

(a) when all gripping devices occupy a first position a first gripping device is brought into gripping engagement with print material, whereas remaining gripping devices grip respective print material on which one colour print has been applied, print material on which two colour prints have been applied, etc., and which rest on respective printing tables with the tables in their upper printing positions;

(b) all tables are then lowered to their respective lower positions, thereby to provide room for linear displacement of the gripping devices to a second position;

(c) with the gripping devices located in this second position according to (b) above, all tables are again raised to their respective upper, printing positions, and a single-colour pattern is applied to respective print materials;

(d) the gripping devices are then released from the print materials;

(e) respective printing tables are lowered to their lower positions with the print materials resting on said tables;

(f) all gripping devices are withdrawn to their respective first positions and the printing tables, together with the print material resting thereon, are raised to their upper positions;

(g) whereafter steps (a) to (f) above are repeated.

According to one embodiment of the invention, the last gripping device is caused to remove the print material from the last printing table and deposit the material on a disposal or laying-off table.

Preferably, respective colour prints are dried during their passage across a space located between mutually adjacent printing tables The print material is also preferably brought to a registered position on each printing table, so that the stencil pattern is transferred precisely onto the intended part of the print material.

The invention also relates to a silkscreen printer arrangement which will enable a plurality of single-colour patterns to be applied in a given order onto a piece of material which is to receive print, i.e. print material, so as to obtain a multicoloured print. To this end, the silkscreen printer includes a plurality of printing tables which are arranged in the path travelled by the print material(s) through the printer and each of which cooperates with a respective stencil which is located above said table and the pattern of which corresponds to a single colour print forming part of said multicoloured print. The printer further includes a print material transporting means having gripping means which are intended first to feed print material to a first printing table, where a first single-colour print is transferred to the print material by said stencil, and then to feed the thus printed material to a second printing table, where a second single-colour print is applied to said material via the stencil located above said table, and so on.

The functions of the transporting means, the activation of the print material gripping devices and the movements of the printing tables shall all be so coordinated that (a) when all gripping devices occupy a first position a first gripping device is brought into gripping engagement with print material, whereas remaining gripping devices grip respective print material on which one colour print has been applied, print material on which two colour prints have been applied, etc., and which rest on respective printing tables with the tables in their upper printing positions;

(b) all tables are then lowered to their respective lower positions, thereby to provide room for linear displacement of the gripping devices to a second position;

(c) with the gripping devices located in this second position according to (b) above, all tables are again raised to their respective upper, printing positions, and a single-colour pattern is applied to respective print materials;

(d) the gripping devices are then released from the print materials;

(e) respective printing tables are lowered to their lower positions with the print materials resting on said tables;

(f) all gripping devices are withdrawn to their respective first positions and the printing tables, together with the print material resting thereon, are raised to their upper positions;

(g) whereafter steps (a) to (f) above are repeated.

In accordance with one advantageous embodiment the last gripping device is intended to grip the multicoloured print on the last printing table in the line and deposit the print on a disposal table.

Preferably there is provided between mutually adjacent printing tables a drying apparatus for drying print newly applied to the print material.

Means are also provided for registering the print material on respective printing tables, so that the stencil patterns are transferred precisely onto intended parts of the print material.

A drying apparatus or section based on radio frequencies is arranged between mutually adjacent silkscreen printers.

It is also proposed in accordance with one variant of the inventive arrangement that means are provided for sensing the position of print material on respective tables, and that means are provided for displacing respective stencils in response to established discrepancies to a position in which the stencil pattern will be transferred on the intended parts of the print material.

ADVANTAGES

Those advantages which can be considered characteristic of a method and an arrangement according to the invention reside in the possibility of constructing, simply and quickly, a silkscreen printer which will enable a plurality of single-colour prints to be applied to a single piece of print material in a given order such as to obtain a multicoloured print, and to dry the print(s) between each single-colour printing process.

The primary characteristic features of a method according to the present invention are set forth in the following claim 1 whereas the characteristic features of an arrangement according to the present invention are set forth in the characterizing clause of the following claim 5.

BRIEF DESCRIPTION OF THE DRAWINGS

A preferred embodiment of a silkscreen printer arrangement for applying a plurality of single-colour prints to a single piece of print material in a given order to form a multicoloured print will now be described in more detail with reference to the accompanying drawing, in which.

DESCRIPTION OF PREFERRED EMBODIMENTS

The following description is made with reference to a silk-screen printer which has been constructed in a manner which enables the inventive method to be carried out.

Figure 1:
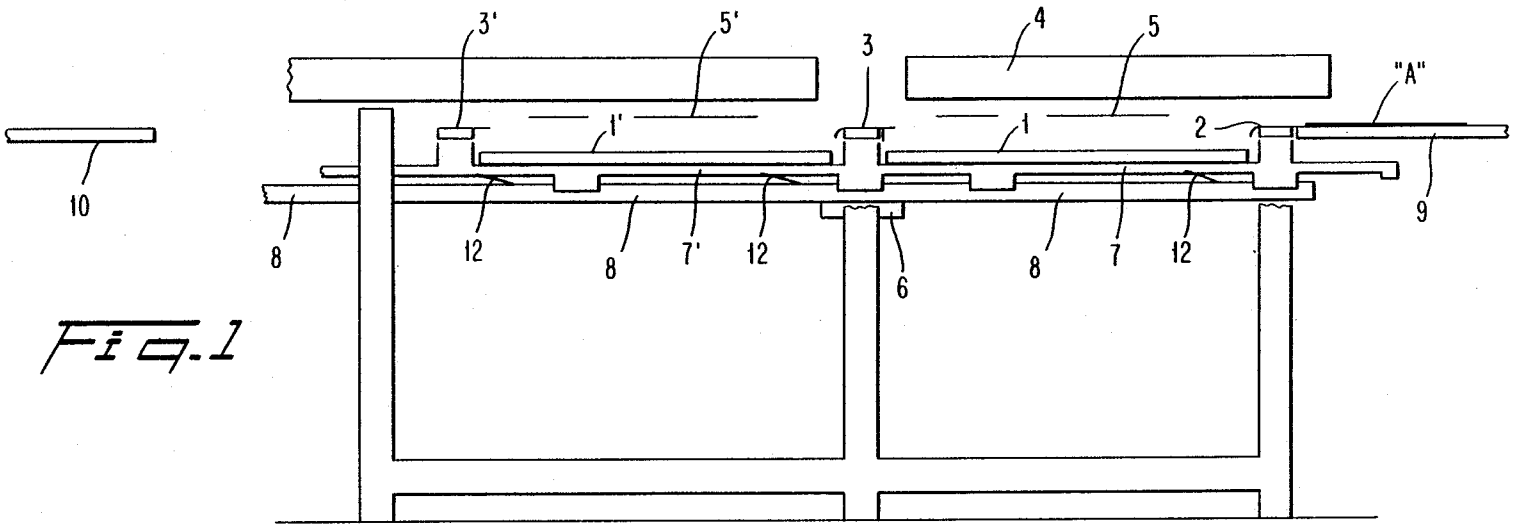
FIG. 1 is a side view of part of a silkscreen printer with the print material gripping devices in a first position.
Figure 2:
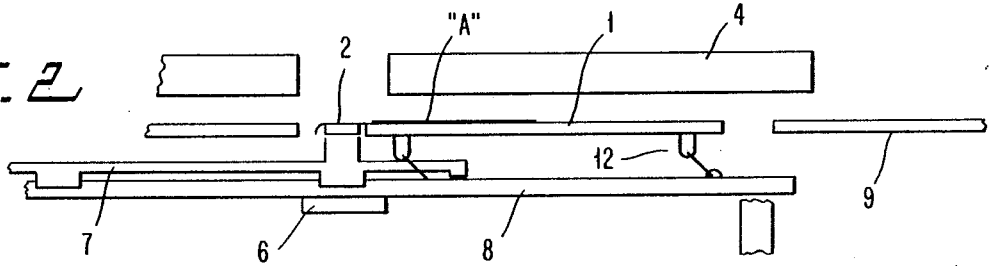
FIG. 2 illustrates the same part of the printer according to FIG. 1, but with the gripping devices in a second position.

The silkscreen printer partially shown in FIGS. 1 and 2 is constructed to enable a multiple of single-colour prints to be made in a given order on an item of print material "A", such as to obtain ultimately a multicoloured pattern thereon.

The term "ink" as used in the present document shall not only be interpreted as referring to the various types of inks and pastes commonly used in silkscreen printers, but shall also be understood to refer to a single ink or paste which has been given different colours.

The illustrated silkscreen printer includes a plurality of printing tables which are positioned in the path travelled by the print material "A" through the printer, first of the tables being referenced 1 and a second being referenced 1'.

The illustrated embodiment thus comprises two sequentially arranged printing tables 1, 1', although it will be understood that the number of printing tables provided will correspond to the number of colours in the multicoloured print to be produced.

Normally the silkscreen printer will incorporate four printing tables arranged in line, and a print material transporting means which is common to all tables.

Although the illustrated silkscreen printer arrangement comprises a plurality of printers which have been "built together", it will b understood that these printers may instead be arranged spaced from one another.

In both cases it is necessary to interconnect the gripper systems of respective silkscreen printers and to make certain minor modification to the grippers.

The illustrated arrangement includes a gripping device guide means 8 comprising two mutually parallel guide rails which extend horizontally through all silkscreen printing units or printers, so as to allow all the mutually interconnected gripping devices to move synchronously backwards and forwards in the printer arrangement. The number of gripping devices will exceed the number of printing tables by one.

The various printer units or printers ma be driven by respective individual drive means or by a common drive means.

Each of the horizontal printing tables is located beneath a stencil, such that the table 1 co-acts with a stencil 5 and the table 1' co-acts with a stencil 5', each stencil being stretched in a stencil frame((not shown). Each frame cooperates with a holder 4 which is stationary in relation to the chassis of the printer arrangement.

The stencil 5 exhibits a first pattern which corresponds to a first single colour included in the intended multicoloured print, and the stencil 5' exhibits a second pattern which corresponds to a second single colour of the multicoloured print.

The illustrated silkscreen printer arrangement also includes a transporting means for transporting the print material "A" firstly to the first printing table 1, where the print material is provided with the first colour print by the stencil 5 located above said table, and from there to the second printing table 1', where the second single-colour print is applied to the print material "A" by the second stencil 5', and so on.

This latter position is shown in more detail in FIG. 2.

In accordance with the invention, respective functions of the print material transporting means, activation of the print material gripping devices and the horizontal printing tables shall be mutually coordinated so that;

(a) when all gripping devices 2, 3, 3' occupy a first position (FIG. 1) a first gripping device 2 will grip a plain print material "A" and the remaining gripping devices 3 and 3' will each grip respective print materials (not shown) provided with one single-colour print and two single-colour prints, and so on, with the print materials each resting on a respective printing table 1, 1' in an upper table position, (b) whereafter all printing tables 1, 1' are lowered to a lower position, so as to provide space for linear movement of the gripping devices to a second position, shown in FIG. 2;

(c) when the gripping devices occupy their respective second positions according to (b) above all printing tables are again raised to their upper, printing positions and a single-colour print is made on respective print materials;

(d) whereafter the gripping devices release their respective print materials;

(e) respective printing tables with newly printed materials resting thereon are lowered to the lower table position;

(f) all gripping devices are withdrawn to their first positions and the printing tables with print material resting thereon are raised to an upper position, and (g) whereafter the steps of (a) to (f) above are repeated.

As will be seen from the Figures, the gripping devices 2, 3 and 3' are reciprocatingly movable along the guide means 8.

The illustrated printer arrangement also includes a laying-on table 9 onto which the print material A is fed in a known manner.

Subsequent to applying a first single-colour pattern to the print material "A" on the printing table 1, a second single-colour print in the printing table 1', etc., the final multicolour print is transferred by the last gripping device in line onto a disposal table 10, which is located in the same plane as the laying-on table 9.

The reference 12 identifies a linkage system by means of which respective tables 1, 1' are moved vertically to their raised and lowered positions.

The gripping devices 2 and 3 are held in predetermined known manner by means of a rod or bar 7, and the gripping devices 3 and 3' are in turn mutually connected by a rod or bar 7.

Because in the case of silkscreen printer arrangements intended for applying a plurality of ingle-colour prints successively onto a single piece of print material such a to obtain a multicolour print, it is necessary for the ink of one print to have dried thoroughly before applying the next print in line, inter alia so that a clearly defined and precisely registered print is obtained on the table 1', and on the subsequent printing tables.

For the purpose of registering the print material on the printing table 1' and subsequent tables, it is proposed that the stencil 5' and remaining stencils is registered and the position of said stencils adjusted in the manner described and illustrated in U.S. Pat. Specification No. 4 516 495.

It is particularly proposed that the recommendations concerning the arrangement of the stencil frames for linear displacement relative to the printer chassis are followed, such as to enable the stencil(s) to be brought to a precise position above the print material, subsequent to evaluating the actual position o the material, and the stencil pattern consequently printed exactly on desired parts of the print material.

However, according to one advantageous embodiment of the inventive silkscreen printer arrangement, there is located between mutually adjacent printing tables a drying section of short longitudinal extension which is operative in drying wet water-based print before applying further print to the print material. One such drying section, or drying apparatus is referenced 6 in the drawing, this drying section being accommodated in the space provided between the two illustrated printing tables. A drying section may also be arranged immediately downstream of the last printing table in the line.

The ink used in this case is preferably water based and the drying sections are constructed to operate with electromagnetic waves of radio frequency.

As will be understood, when the drying sections 6 operate with electromagnetic waves at radio frequencies, no part which is located in the vicinity of the drying sections may consist of an electrically conductive material or be electrically conductive. Consequently, the guide means 8 and, when necessary, the gripping means must be made from an electrically non-conductive material.

A suitable drying section for use in the present context is described and illustrated in U.S. Pat. Ser. No. 3 329 796.

As will be understood from the aforedescribed embodiment of the invention items of print material are transported sequentially in mutually spaced relationship through the printer arrangement, with the distances btween respective print materials being adapted to the distances between respective printing tables, and that a print is applied simultaneously to all print material located beneath a respective stencil in all printers.

This requires each individual print to be brought to a position of registry. This is effected by evaluating the position occupied by the print material in the printing position and, when necessary, by displacing the stencil frame, with stencil, to a position in which the stencil pattern will be printed on the print material in precisely the correct position.

Subsequent to ensuring that all items of print material are in place and that the stencil frames have been adjusted to their correct printing positions, all printers are activated simultaneously to effect a printing operation, by a control unit programmed or constructed herefor.

The control unit then causes the transporting means to step forward all items of print material simultaneously onto respective forwardly located printing tables, where a fresh print is applied.

A previously applied print is dried by the drying section during this forward movement of respective print materials.

Since the control unit used can be constructed readily by the person skilled in this art, without requiring work of an inventive nature, the control unit will not be described in detail here.

According to one advantageous embodiment the printing tables are perforated and means are provided for producing a suction effect through said perforations, such as to hold the print material firmly against its respective printing table, at least immediately prior to and during a printing operation.

It is further emphasized that in the case of a drying section of the aforesaid kind, no electrically conductive component or part may extend into the region where drying is effected, and hence the material transporting means must be constructed accordingly with this in mind.

It will be understood that the invention is no restricted to the aforedescribed exemplifying embodiment and that modifications can be made within the scope of the following claims.

Further it should be noted that the expression pattern in this description also meant solely a colour transfer.

I claim:

1. A method for applying a plurality of colour prints onto print material in a predetermined order in a silk-screen printer so as to obtain a multicolour print on said material, the printer comprising a plurality of printing tables arranged for vertical movement and positioned in the path travelled by the print material through the printer, each of said printing tables cooperates with a respective stencil for transferring to the print material a single colour of said multicolour print, and said printer further including a print material transporting means for advancing the print material to a first printing table, a first colour print is applied to said print material by the stencil located above said first table, and then to a second printing table, where a second colour print forming part of said multicolour print is applied to the print material by the stencil located above said second table, a plurality of gripping means for gripping and registering said print material, the transporting means, activation of the gripping means, and the vertical movement of the printing tables being coordinated for performing the steps of;

(a) positioning said gripping means in a first position corresponding to an uppermost raised position of the printing tables and gripping said print material at each of said plurality of printing tables;

(b) lowering said plurality of printing tables simultaneously and displacing said gripping means linearly to a second position;

(c) raising said plurality of printing tables to the uppermost raised position while maintaining said gripping means in said second position and applying a single color to said print material at each of said plurality of printing tables;

(d) releasing said gripping means from said print material;

(e) lowering said plurality of printing tables while supporting said print material thereon;

(f) drying said single color on said print material while displacing said gripping means to said second position;

(g) withdrawing said gripping means to said first position and moving the printing tables to said uppermost position;

(h) transferring said multicolor print by said gripping means from a final printing table to a receiving table; and (i) repeating steps (a) through (h) for each color of said multicolor print.

* * * * *